US010065437B2

(12) United States Patent
Oguchi et al.

(10) Patent No.: US 10,065,437 B2
(45) Date of Patent: Sep. 4, 2018

(54) PRINTER

(71) Applicant: FUJITSU COMPONENT LIMITED, Tokyo (JP)

(72) Inventors: Tatsuya Oguchi, Tokyo (JP); Sumio Watanabe, Tokyo (JP); Yukihiro Mori, Tokyo (JP); Masahiro Tsuchiya, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 0 days.

(21) Appl. No.: 15/498,703

(22) Filed: Apr. 27, 2017

(65) Prior Publication Data

US 2017/0341426 A1 Nov. 30, 2017

(30) Foreign Application Priority Data

May 24, 2016 (JP) ..... 2016-103097

(51) Int. Cl.

| | |
|---|---|
| ***B41J 11/04*** | (2006.01) |
| ***B41J 29/02*** | (2006.01) |
| ***B41J 11/70*** | (2006.01) |

(52) U.S. Cl.

CPC ..... *B41J 11/04* (2013.01); *B41J 11/70* (2013.01); *B41J 29/02* (2013.01)

(58) Field of Classification Search

CPC ..... B41J 11/04; B41J 11/70; B41J 29/02
USPC ..... 347/220
See application file for complete search history.

(56) References Cited

U.S. PATENT DOCUMENTS

| | | | |
|---|---|---|---|
| 6,118,469 | A | 9/2000 | Hosomi |
| 6,744,457 | B2 | 6/2004 | Seino et al. |
| 2003/0118390 | A1 | 6/2003 | Yamada et al. |
| 2006/0291933 | A1 | 12/2006 | Watanabe et al. |
| 2009/0103963 | A1 | 4/2009 | Takabatake et al. |
| 2009/0309947 | A1 | 12/2009 | Bandholz et al. |
| 2011/0072995 | A1 | 3/2011 | Kamata |

FOREIGN PATENT DOCUMENTS

| | | |
|---|---|---|
| EP | 0747225 | 12/1996 |
| EP | 2765005 | 8/2014 |
| JP | 2003-246104 | 9/2003 |

*Primary Examiner* — Huan Tran
*Assistant Examiner* — Alexander D Shenderov
(74) *Attorney, Agent, or Firm* — IPUSA, PLLC

(57) ABSTRACT

A printer includes a print head; a platen roller; a frame, to which the print head or the platen roller is attached, that includes a frame body, a sidewall that is perpendicularly bent from the frame body with respect to a longitudinal direction of the platen roller, and a back surface member that is bent from the frame body in parallel to the longitudinal direction of the platen roller, the back surface member including an end portion and a support portion provided to support the sidewall from an inner side and an outer side of the sidewall, respectively, the sidewall being supported by the back surface member while being interposed between the end portion the support portion of the back surface member.

8 Claims, 18 Drawing Sheets

PRINTER

CROSS-REFERENCE TO RELATED APPLICATION

The present application is based on and claims the benefit of priority of Japanese Priority Application No. 2016-103097 filed on May 24, 2016, the entire contents of which are hereby incorporated by reference.

BACKGROUND OF THE INVENTION

1. Field of the Invention

The present invention relates to a printer.

2. Description of the Related Art

A printer is widely used at a cash register in a shop, an Automated Teller Machine (ATM) or a cash dispenser of a bank or the like.

Such a printer, for example, includes a printer mechanical unit on which a thermal head or the like is mounted, and a platen unit including a platen roller, and the printer mechanical unit and the platen unit are connected with each other.

In such a printer, the printer mechanical unit includes a frame made of metal or the like to which a gearbox, a motor or the like for rotating the platen roller of the platen unit is attached.

It is required for the printer in which the gearbox, the motor or the like is attached to the frame, as described above, to be manufactured with low cost, and to have high strength such as not being deformed or the like even when fallen.

PATENT DOCUMENT

[Patent Document 1] Japanese Laid-open Patent Publication No. 2003-246104

SUMMARY OF THE INVENTION

According to an embodiment, there is provided a printer including: a print head; a platen roller; a frame, to which the print head or the platen roller is attached, that includes a frame body, a sidewall that is perpendicularly bent from the frame body with respect to a longitudinal direction of the platen roller, and a back surface member that is bent from the frame body in parallel to the longitudinal direction of the platen roller, the back surface member including an end portion and a support portion provided to support the sidewall from an inner side and an outer side of the sidewall, respectively, the sidewall being supported by the back surface member while being interposed between the end portion the support portion of the back surface member.

BRIEF DESCRIPTION OF THE DRAWINGS

Other objects, features and advantages of the present invention will become more apparent from the following detailed description when read in conjunction with the accompanying drawings.

FIG. 10A to FIG. 100 are views illustrating an example of the frame of the second embodiment;

DETAILED DESCRIPTION OF THE PREFERRED EMBODIMENTS

Figure 1A:
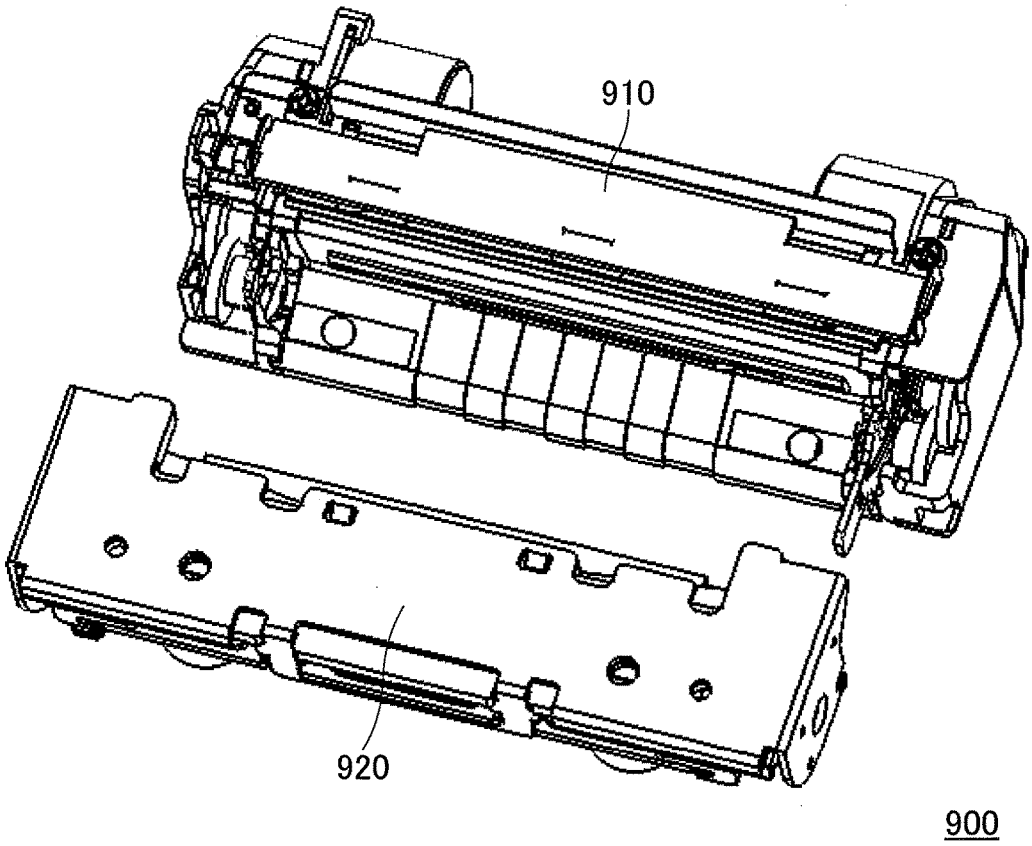
FIG. 1A and FIG. 1B are views for describing an example of a printer.

The invention will be described herein with reference to illustrative embodiments. Those skilled in the art will recognize that many alternative embodiments can be accomplished using the teachings of the present invention and that the invention is not limited to the embodiments illustrated for explanatory purposes.

It is to be noted that, in the explanation of the drawings, the same components are given the same reference numerals, and explanations are not repeated.

Figure 1B:
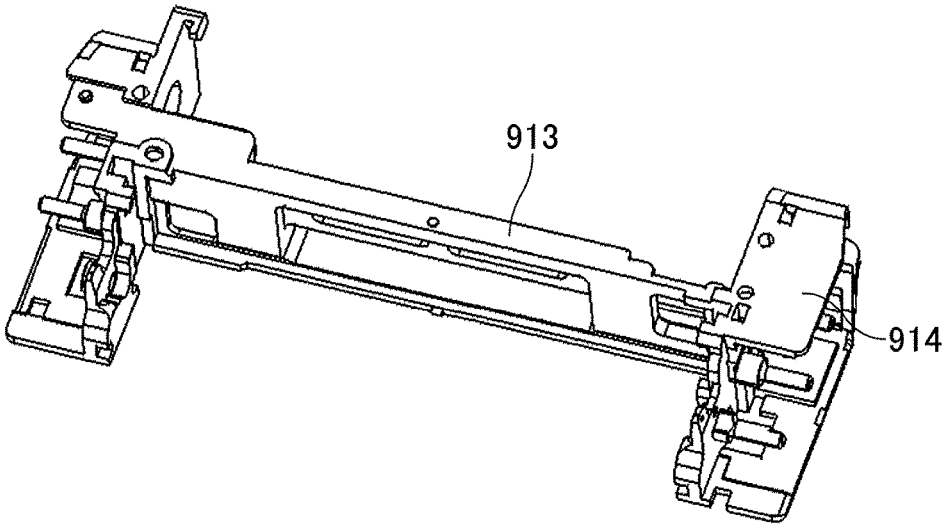

FIG. 1A and FIG. 1B are views for describing an example of a printer 900. As illustrated in FIG. 1A, the printer 900 includes a printer mechanical unit 910 and a platen unit 920 that are connected with each other. The platen unit 920 includes a platen roller.

FIG. 1B illustrates a frame 913 included in the printer mechanical unit 910. In the printer mechanical unit 910, a thermal head, a gearbox 914 and a motor that rotate the platen roller of the platen unit 920 are attached to the frame 913. As illustrated in FIG. 1B, the gearbox 914 is integrally formed with the frame 913. Thus, strength of an end portion of the frame 913 at which the gearbox 914 is formed is high, and the end portion of the frame 913 is not deformed even when force is applied thereto or the frame 913 is fallen.

However, the frame 913 with which the gearbox 914 is integrally formed is manufactured by casting or the like. Thus, a manufacturing process is complicated, and cost becomes high. Further, as the frame 913 and the gearbox 914 are integrally formed, it is necessary to prepare different types of frames 913 for manufacturing different types of printers in which widths of used print papers are different.

Figure 2:
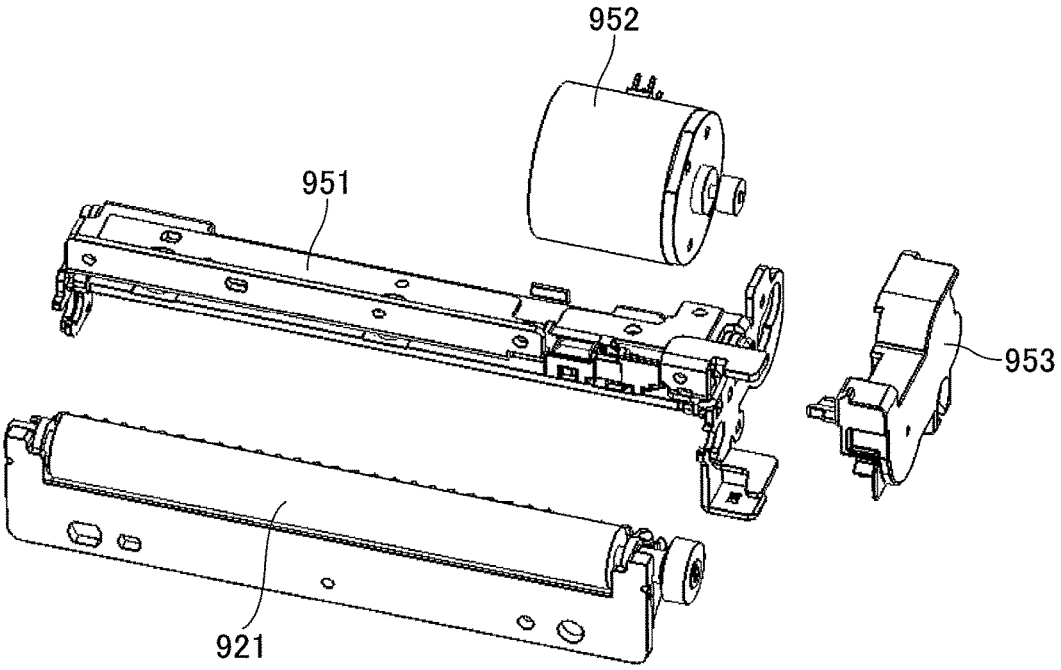
FIG. 2 is a view for describing an example of a printer.

Meanwhile, there is a method for manufacturing a frame with low cost by punching a metal plate, bending it in accordance with a width of a used print paper, and attaching a commonly prepared gearbox and a motor to the frame. FIG. 2 to FIG. 3C are views illustrating an example of such a frame 951 of a printer. As illustrated in FIG. 2 to FIG. 3C, the frame 951 of a printer mechanical unit is formed by punching and bending a metal plate to form a frame body 951*b* and a sidewall 951*a*. A motor 952 and a gearbox 953 are attached to the sidewall 951*a* of the frame 951.

Figure 3A:
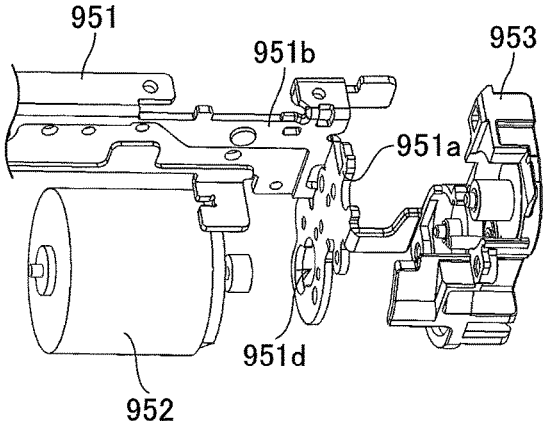
FIG. 3A to FIG. 3C are views illustrating an example of the printer.
Figure 3B:
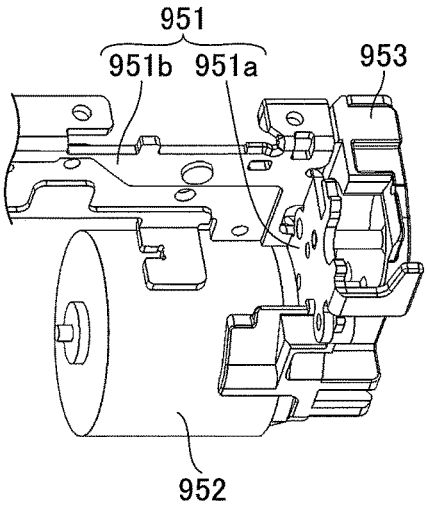
Figure 3C:
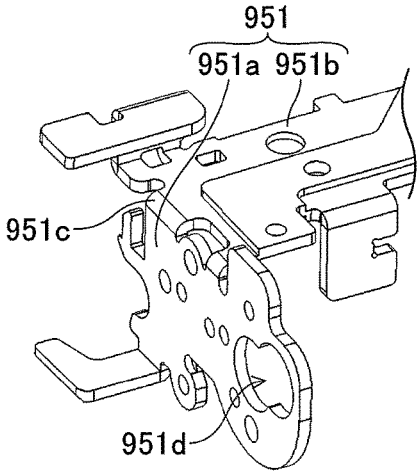

FIG. 3A is an enlarged view illustrating the frame 951 before the motor 952 and the gearbox 953 are attached to the sidewall 951*a*. FIG. 3B is an enlarged view illustrating the frame 951 after the motor 952 and the gearbox 953 are attached to the sidewall 951*a*. FIG. 3C is an enlarged view of the sidewall 951*a*.

As illustrated in FIG. 3C, the sidewall 951*a* is formed by perpendicularly bending the metal plate at a bent portion 951*c* near an end of the frame 951. The motor 952 is attached at an inner side of the sidewall 951*a*, and the gearbox 953 is attached at an outer side of the sidewall 951*a*. The motor 952 and the gearbox 953 are connected with each other in a through-hole 951*d* provided at the sidewall 951*a*.

As the motor 952 is heavy, if strong force is applied to the sidewall 951*a* to which the motor 952 and the gearbox 953 are attached, the sidewall 951*a* may be deformed with respect to the frame body 951*b*. Further, as the sidewall 951*a* is formed by bending the frame 951, if it is fallen, there is a risk that the sidewall 951*a* is deformed. If the sidewall 951*a* is deformed, there is a risk that the rotation of the motor 952 is not normally transmitted to a platen roller 921.

Furthermore, even for a printer, different from the printer illustrated in FIG. 2 to FIG. 3C, including a drive unit, in which the motor and the gearbox are connected with each other, is attached to the sidewall of a frame, if it is fallen, the sidewall of the frame may be deformed as well.

Thus, a printer is required that can be manufactured with low cost, a frame or a printer housing including a frame of which is hardly deformed, and whose strength is high.

First Embodiment

Figure 4A:
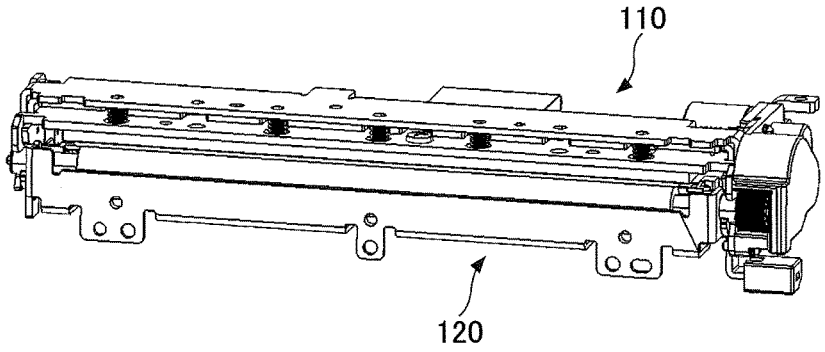
FIG. 4A and FIG. 4B are perspective views of an example of a printer of a first embodiment.
Figure 4B:
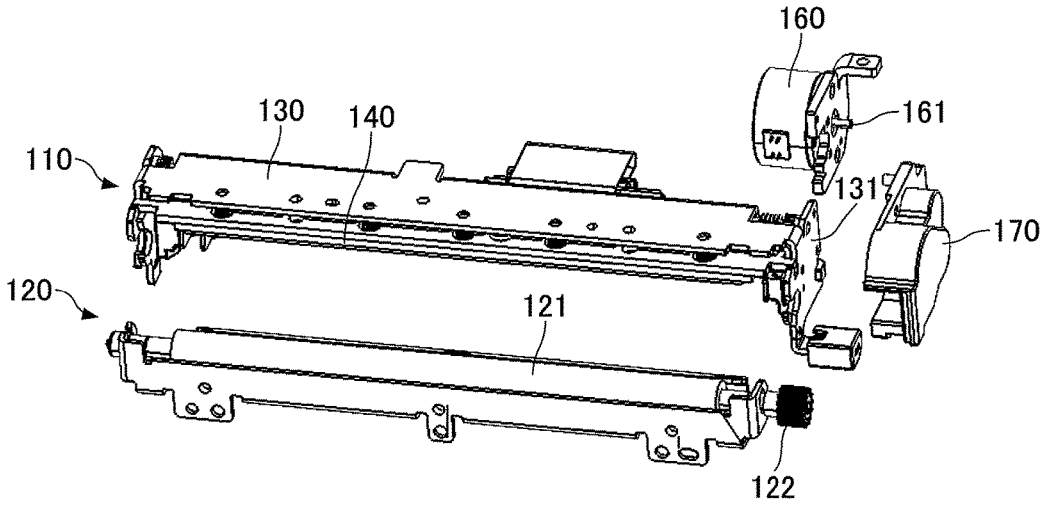

Next, a printer of a first embodiment is described. As illustrated in FIG. 4A and FIG. 4B, the printer of the embodiment includes a printer mechanical unit 110 and a platen unit 120 connected to the printer mechanical unit 110. FIG. 4A is a perspective view illustrating a state in which the printer mechanical unit 110 and the platen unit 120 are connected, and FIG. 4B is a perspective view illustrating a state in which the printer mechanical unit 110 and the platen unit 120 are separated.

The printer mechanical unit 110 includes a frame 130, a thermal head 140, which is a print head, and a print paper guide. The thermal head 140 and the print paper guide are attached to the frame 130. Further, a transfer motor 160 and a transfer module 170 such as a gearbox are attached to one sidewall 131 of the frame 130. In this embodiment, the transfer motor 160 is attached at an inner side of the sidewall 131, and the transfer module 170 is attached at an outer side of the sidewall 131.

The platen unit 120 includes a platen roller 121 and a gear 122 attached at an end portion of the platen roller 121. The transfer module 170 includes a plurality of gears, and transmits a rotation of the transfer motor 160 to the platen roller 121 by changing a rotation frequency, if necessary. The transfer motor 160 includes a gear 161 attached to a rotational shaft of the transfer motor 160. The gear 161 of the transfer motor 160 engages with one of the gears of the transfer module 170. Under the state as illustrated in FIG. 4A in which the printer mechanical unit 110 and the platen unit 120 are connected with each other, the gear 122 of the platen roller 121 engages with another one of the gears of the transfer module 170. When the transfer motor 160 is rotated under this state, the rotation of the transfer motor 160 is transmitted to the one of the gears of the transfer module 170 via the gear 161. Then, the rotation is further transmitted to the gear 122 of the platen roller 121 to rotate the platen roller 121. With this configuration, the platen roller 121 is rotated by the transfer motor 160.

Here, the transfer motor 160 includes inside it iron core, a coil and the like, and is heavy. Further, the transfer module 170 includes inside it the gears and is covered by a housing. The housing is sturdy formed so as an impact is not affected on engagements of the gears included its inside even when external force is applied, and for example, made of a metal material.

Next, the frame 130 is described with reference to FIG. 5A to FIG. 6C. The frame 130 is formed by punching a metal plate such as stainless and thereafter bending (folding) it. The frame 130 is formed to include sidewalls 131 and 132, an upper surface member (frame body) 133 and a back surface member 134. The sidewalls 131 and 132 are formed by bending both end portions of the frame 130, and a portion that extends from the sidewall 131 to the sidewall 132 in a longitudinal direction is the upper surface member 133. In other words, the sidewalls 131 and 132 are formed at both ends of the upper surface member 133.

Figure 5A:
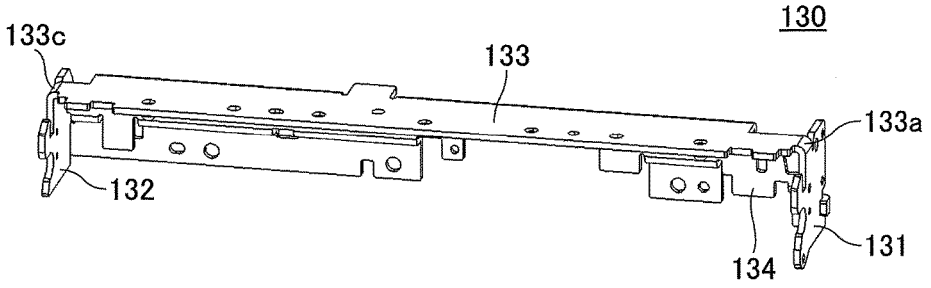
FIG. 5A to FIG. 5C are views illustrating an example of a frame of the first embodiment.
Figure 5B:
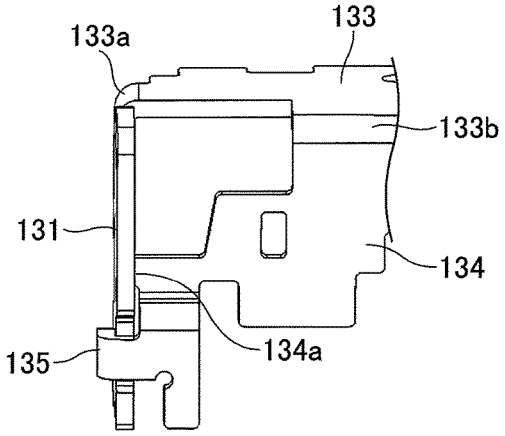
Figure 5C:
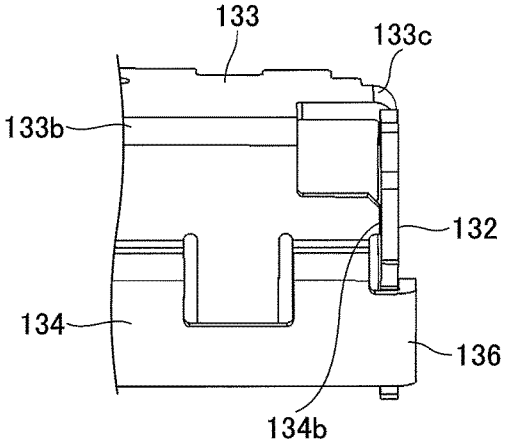
Figure 6A:
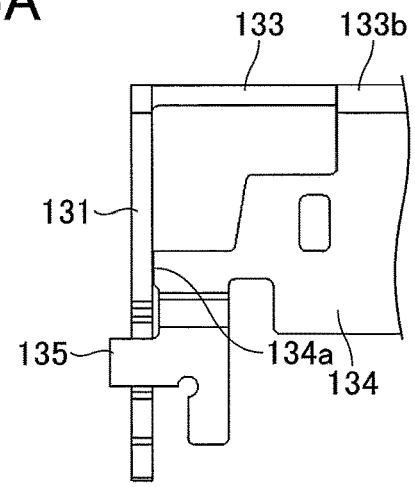
FIG. 6A to FIG. 6C are views illustrating an example of the frame of the first embodiment.
Figure 6B:
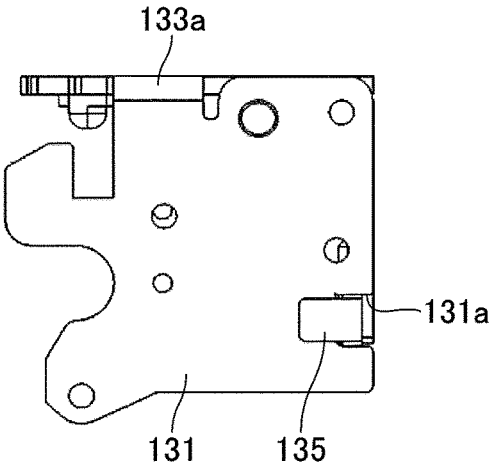
Figure 6C:
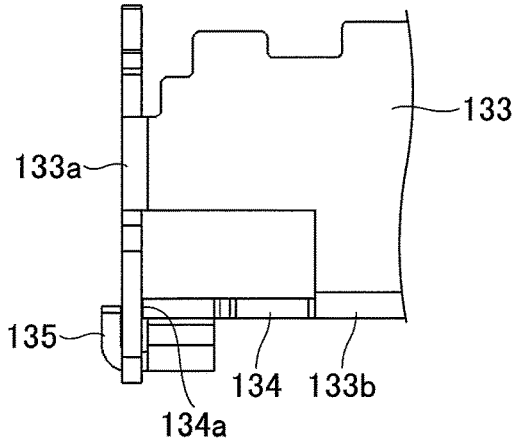

FIG. 5A is a perspective view of the frame 130. FIG. 5B is a partial perspective view of the frame 130 illustrating a portion at which the sidewall 131 is formed in an enlarged manner seen from a back surface member 134 side. FIG. 5C is a partial perspective view of the frame 130 illustrating a portion at which the sidewall 132 is formed in an enlarged manner seen from the back surface member 134 side. FIG. 6A is a partial back side view of the back surface member 134 illustrating a portion at which the sidewall 131 is formed. FIG. 6B is a side view illustrating the sidewall 131. FIG. 6C is a partial top view of the frame 130 illustrating a portion at which the sidewall 131 is formed.

The sidewall 131 is formed by bending the material of the frame 130 at a bent portion 133*a* near one end portion in a direction perpendicular to the upper surface member 133. The back surface member 134 is formed by bending the material of the frame 130 at a bent portion 133*b* that extends along a longitudinal direction of the upper surface member 133 in a direction perpendicular to the upper surface member 133. The sidewall 132 is formed by bending the material of the frame 130 at a bent portion 133*c* near another end portion in the direction perpendicular to the upper surface member 133. In other words, the sidewall 131 and the sidewall 132 are bent in a direction that is perpendicular to the longitudinal direction of the platen roller 121, and the back surface member 134 is bent in a direction that is in parallel to the longitudinal direction of the platen roller 121.

The back surface member 134 includes a support portion 135 (see FIG. 5B, for example) and a support portion 136 (see FIG. 5C, for example) at both ends near the sidewall 131 and the sidewall 132, respectively.

As illustrated in FIG. 5B and FIG. 6A to FIG. 6C, the sidewall 131 is supported by the back surface member 134 such that one end portion 134*a* of the back surface member 134 contacts an inner surface of the sidewall 131 and the support portion 135 contacts an outer surface of the sidewall 131. As illustrated in FIG. 6B, the sidewall 131 is provided with a notch portion 131*a*. The support portion 135 is provided to be bent at a portion corresponding to the notch portion 131*a* of the sidewall 131.

Figure 7A:
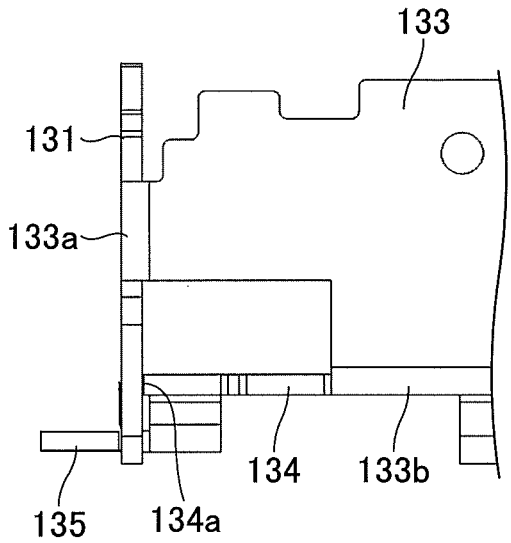
FIG. 7A and FIG. 7B are views illustrating an example of the frame of the first embodiment.
Figure 7B:
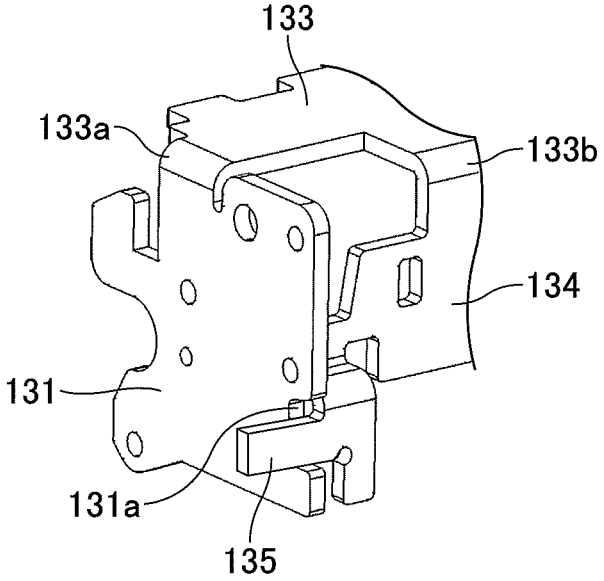

FIG. 7A is a partial top view of the frame 130 corresponding to FIG. 6C before the support portion 135 is bent. FIG. 7B is a partial perspective view of the frame 130 illustrating a portion at which the sidewall 131 is formed before the support portion 135 is bent. As illustrated in FIG. 7A and FIG. 7B, when the sidewall 131 is bent at the bent portion 133*a*, and the back surface member 134 is bent at the bent portion 133*b*, the support portion 135 protrudes at the outer side of the sidewall 131 from the notch portion 131*a* of the sidewall 131. Then, from this state, by bending the support portion 135 to contact the outer surface of the sidewall 131, as illustrated in FIG. 5B and FIG. 6A to FIG. 6C, the sidewall 131 is supported by the back surface member 134 while being interposed between the end portion 134*a* and the support portion 135 of the back surface member 134.

In the frame 130 of the embodiment, the sidewall 131 is formed by being bent at the bent portion 133*a*, and the sidewall 131 and the upper surface member 133 are connected at the bent portion 133*a*. Similarly, in the frame 130 of the embodiment, the back surface member 134 is formed by being bent at the bent portion 133*b*, and the back surface member 134 and the upper surface member 133 are connected at the bent portion 133*b*. Further, the sidewall 131 is supported by the back surface member 134 while being interposed between the end portion 134*a* and the support portion 135. The sidewall 131 and the support portion 135 are connected at this portion. In other words, the sidewall 131 and the back surface member 134 are connected via the upper surface member 133 while being directly connected by the end portion 134*a* and the support portion 135 of the back surface member 134. Thus, strength of a portion of the sidewall 131 that is connected to the upper surface member 133 and the back surface member 134 is high. Thus, even when the frame 130 is fallen under a state that the transfer motor 160 and the transfer module 170 are attached to the sidewall 131, the frame 130 is hardly deformed.

Similarly, as illustrated in FIG. 5A, the sidewall 132 is formed by bending the material of the frame 130 at a bent portion 133*c* near the other end portion in the direction perpendicular to the upper surface member 133. Similarly as the sidewall 131, the sidewall 132 is provided with a notch portion. Furthermore, similar to the support portion 135, the support portion 136 is bent at a portion corresponding to the notch portion of the sidewall 132 to contact an outer surface of the sidewall 132. With this configuration, the sidewall 132 is supported by the back surface member 134. In other words, as illustrated in FIG. 5C, the sidewall 132 is supported by the back surface member 134 such that another end portion 134*b* of the back surface member 134 contacts an inner surface of the sidewall 132 and the support portion 136 contacts the outer surface of the sidewall 132. The sidewall 132 is supported by the back surface member 134 while being interposed between the other end portion 134*b* and the support portion 136 of the back surface member 134 and is connected to the back surface member 134 and the support portion 136. In other words, similar to the sidewall 131, the sidewall 132 and the back surface member 134 are connected via the upper surface member 133 while being directly connected by the end portion 134*b* and the support portion 136 of the back surface member 134.

Thus, strength is high as the sidewall 132 is connected to both of the upper surface member 133 and the back surface member 134.

Here, when a printer cutter unit is provided, a motor or the like that drives a movable cutter of the cutter unit may be attached to the sidewall 132.

The printer of the embodiment can be manufactured with low cost because the frame 130 is formed by punching and bending a metal plate. Further, as the sidewall 131 to which the transfer motor 160 and the transfer module 170 are attached is connected to both of the upper surface member 133 and the back surface member 134, strength of the frame 130 is high and it is not deformed even when fallen.

Second Embodiment

Figure 8A:
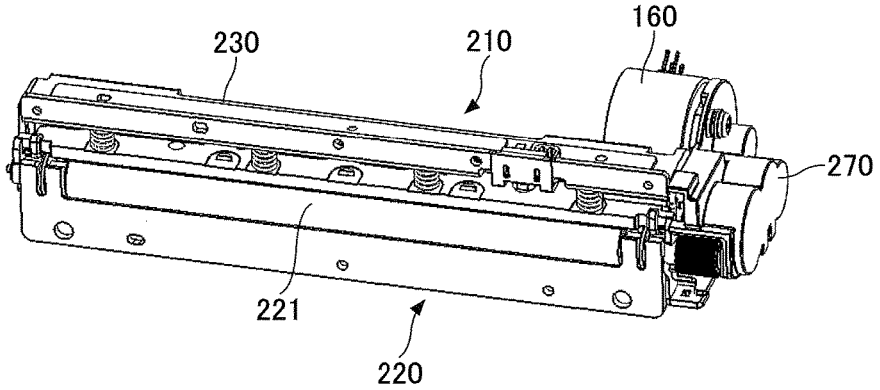
FIG. 8A and FIG. 8B are perspective views of an example of a printer of a second embodiment.
Figure 8B:
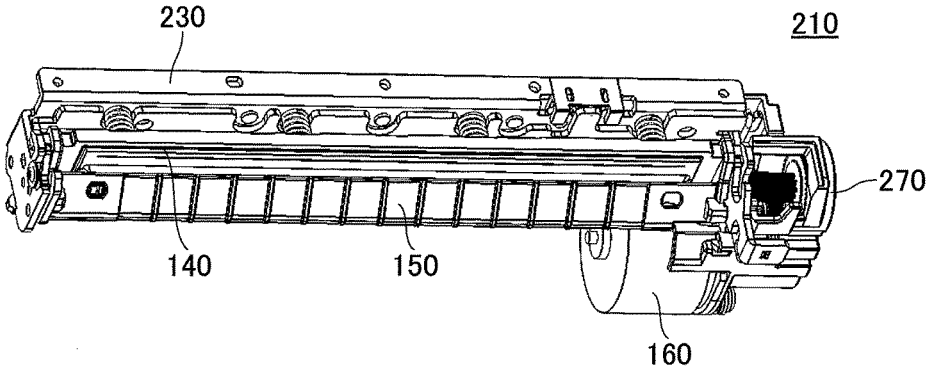

Next, a printer of a second embodiment is described with reference to FIG. 8A to FIG. 9B. FIG. 8A is a perspective view in which a printer mechanical unit 210 and a platen unit 220 are connected, and FIG. 8B is a perspective view of the printer mechanical unit 210.

The printer mechanical unit 210 includes a frame 230 to which a thermal head 140 and a print paper guide 150 are attached. Further, the transfer motor 160 and a transfer module 270 such as the gearbox are attached to one sidewall 231 of the frame 230. In this embodiment, the transfer motor 160 is attached at an inner side of the sidewall 231 of the frame 230 and the transfer module 270 is attached at an outer side of the sidewall 231 of the frame 230.

The transfer module 270 includes a plurality of gears, and transmits a rotation of the transfer motor 160 to a platen roller 221 of the platen unit 220. The gears in the transfer module 270 are covered by a housing made of a metal material, for example. The housing is sturdy formed so as an impact is not affected on engagements of the gears included its inside even when external force is applied, and for example, made of a metal material.

Figure 9A:
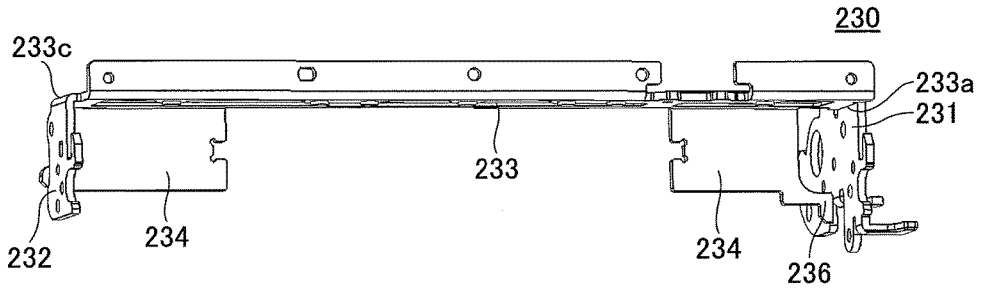
FIG. 9A and FIG. 9B are views illustrating an example of a frame of the second embodiment.
Figure 9B:
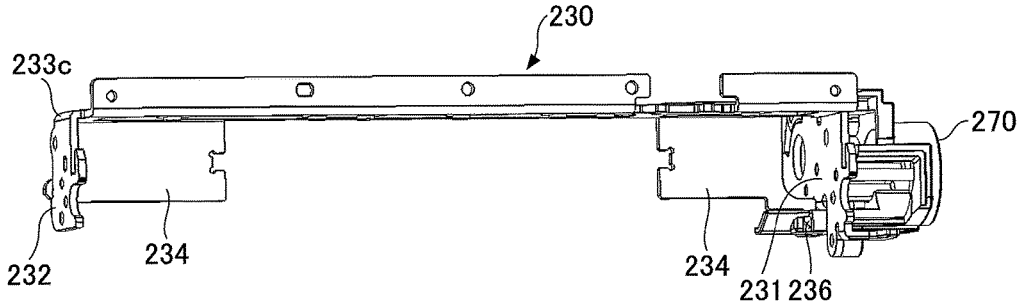

Next, the frame 230 of the embodiment is described with reference to FIG. 9A and FIG. 9B. FIG. 9A is a perspective view of the frame 230. FIG. 9B is a perspective view in which the transfer module 270 is attached to the sidewall 231. The frame 230 is formed by punching a metal plate such as stainless and thereafter bending (folding) it. The frame 230 is formed to include sidewalls 231 and 232, an upper surface member (frame body) 233 and a back surface member 234. The sidewalls 231 and 232 are formed by bending both end portions of the frame 230, and a portion between the sidewall 231 and the sidewall 232 is the upper surface member 233.

In this embodiment, the sidewall 231 is formed by bending the material of the frame 230 at a bent portion 233*a* near one end portion in a direction perpendicular to the upper surface member 233. The back surface member 234 is formed by bending the material of the frame 230 at a bent portion 233*b* that extends along a longitudinal direction of the upper surface member 233 in a direction perpendicular to the upper surface member 233. The sidewall 232 is formed by bending the material of the frame 230 at a bent portion 233*c* near another end portion in the direction perpendicular to the upper surface member 233. In other words, the sidewall 231 and the sidewall 232 are bent in a direction that is perpendicular to the longitudinal direction of the platen roller 221, and the back surface member 234 is bent in a direction that is in parallel to the longitudinal direction of the platen roller 221.

Figure 10A:
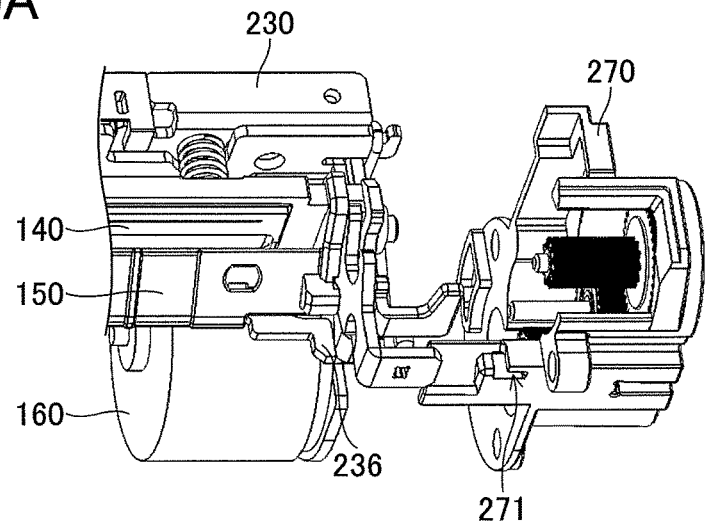

As illustrated in FIG. 9A, a protrusion 236 is provided at the back surface member 234 near the sidewall 231. Further, as illustrated in FIG. 10A to FIG. 100, the transfer module 270 is provided with an engaging hole 271 corresponding to the protrusion 236 of the back surface member 234. FIG.

Figure 10B:
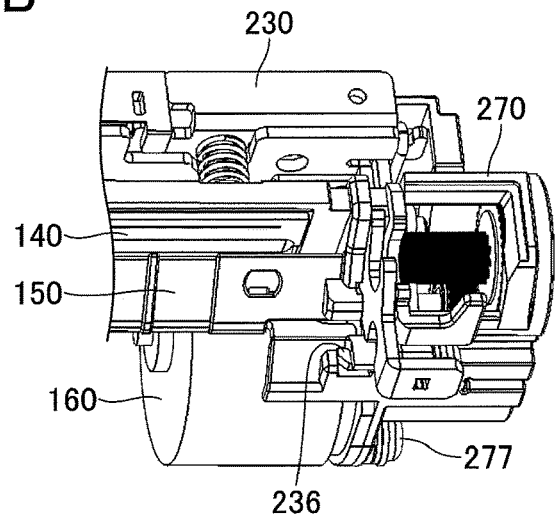
Figure 10C:
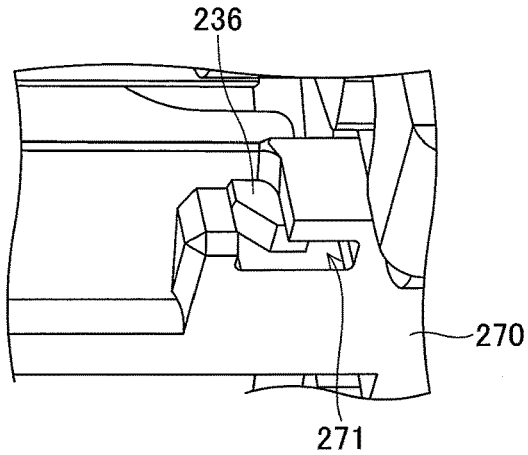

10A is a partial perspective view illustrating the frame 230 and the transfer module 270 before the transfer module 270 is attached to the sidewall 231 in an enlarged manner. FIG. 10B is a partial perspective view illustrating the frame 230 and the transfer module 270 after the transfer module 270 is attached to the sidewall 231. FIG. 100 is an enlarged view of FIG. 10B illustrating the protrusion 236 and the engaging hole 271.

By attaching the transfer module 270 to the sidewall 231, strength of a portion including the frame 230 can be increased. This means, as described above, as strength of the housing of the transfer module 270 in which the gears are included is high, by attaching the transfer module 270 at the outer side of the sidewall 231, strength of the printer housing including the frame 230 can be increased.

Figure 11A:
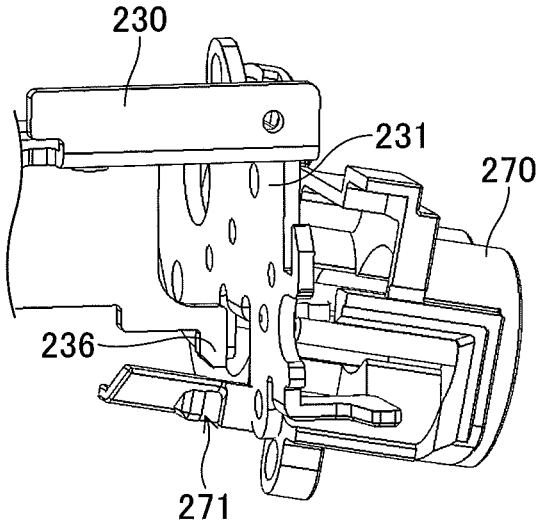
FIG. 11A and FIG. 11B are views illustrating steps of attaching a transfer module to the frame of the second embodiment.
Figure 11B:
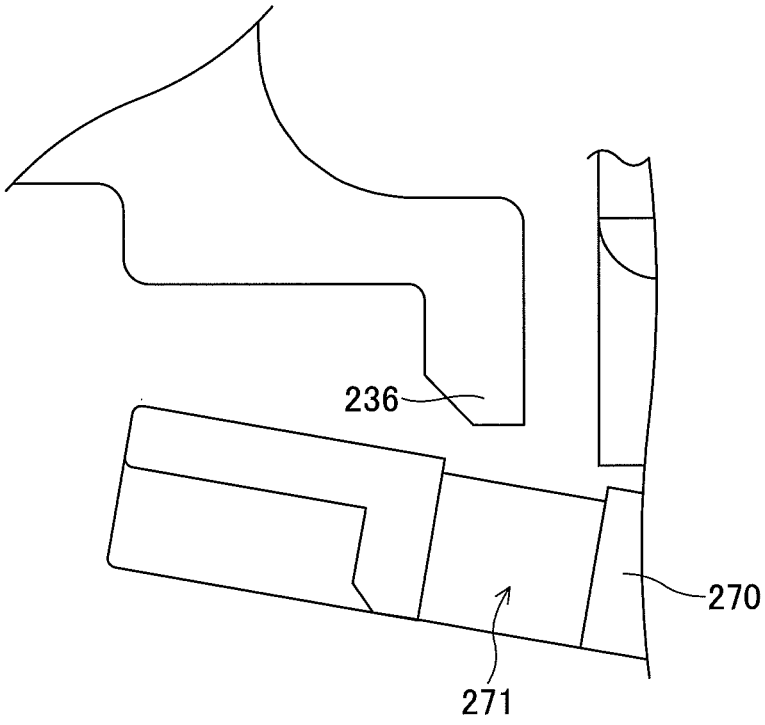
Figure 12A:
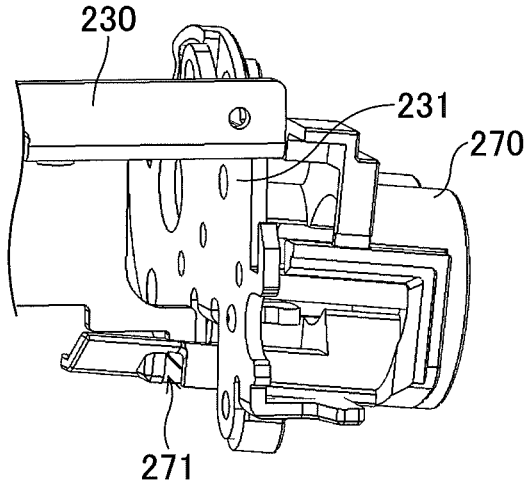
FIG. 12A and FIG. 12B are views illustrating steps of attaching the transfer module to the frame of the second embodiment.
Figure 12B:
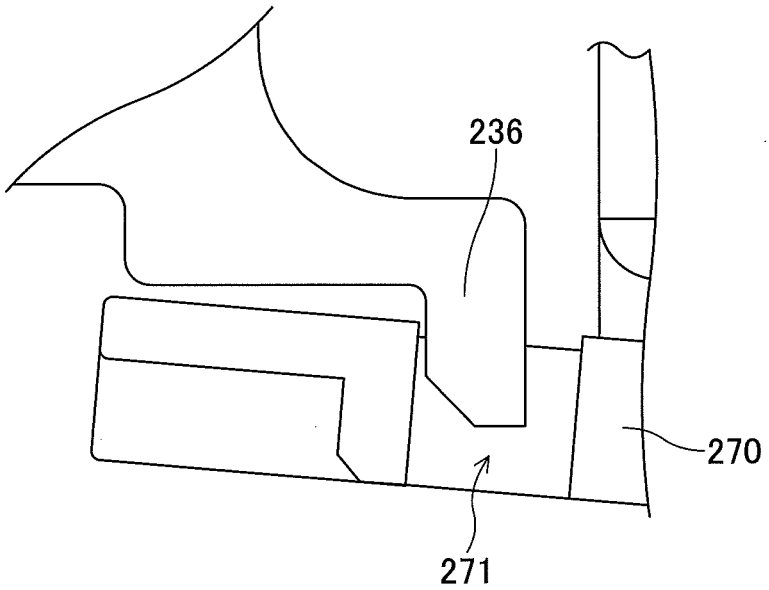
Figure 13A:
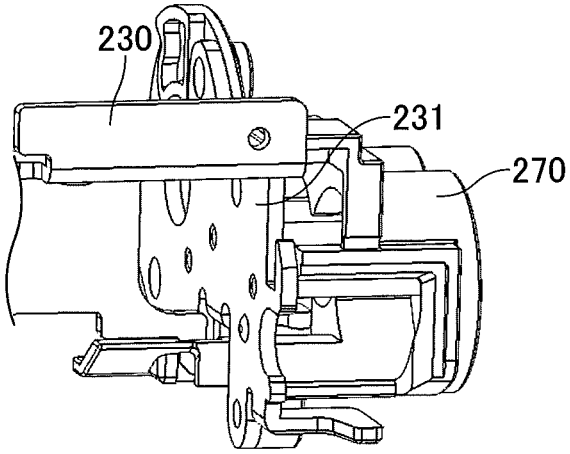
FIG. 13A and FIG. 13B are views illustrating steps of attaching the transfer module to the frame of the second embodiment.
Figure 13B:
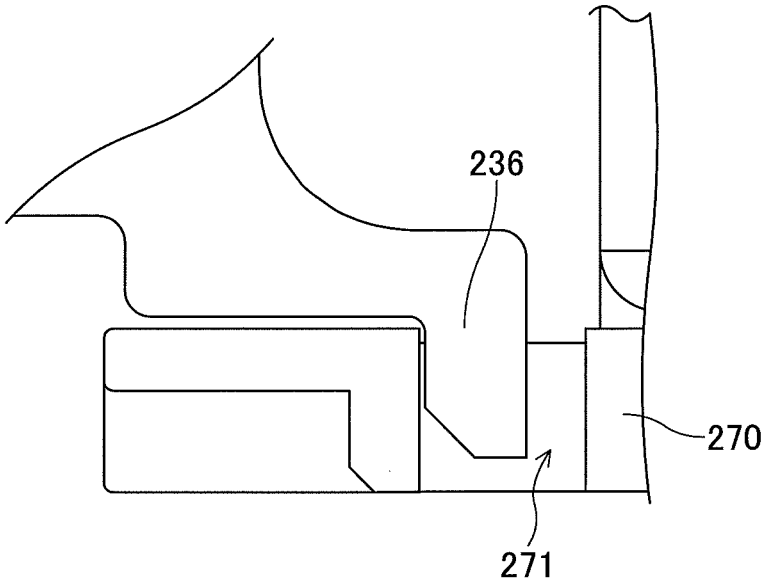

In this embodiment, the transfer module 270 is further attached to the frame 230 by inserting the protrusion 236 of the back surface member 234 of the frame 230 in the engaging hole 271 of the transfer module 270. This process is described with reference to FIG. 11A to FIG. 13B. FIG. 11A, FIG. 12A and FIG. 13A are enlarged perspective views, and FIG. 11B, FIG. 12B and FIG. 13B are cross-sectional views illustrating a part of the printer in these steps. The protrusion 236 of the back surface member 234 is inserted in the engaging hole 271 of the transfer module 270 as illustrated in FIG. 13A and FIG. 13B from a state in which the transfer module 270 is tilted with respect to the sidewall 231 as illustrated in FIG. 11A to FIG. 11B while passing through a state as illustrated in FIG. 12A and FIG. 12B. Thereafter, as illustrated in FIG. 10B, the frame 230 and the transfer module 270 are screwed by a screw 277.

In this embodiment, the protrusion 236 of the back surface member 234 is formed to have a shape that fits in the engaging hole 271 of the transfer module 270 such that front, back, left and right surfaces of the protrusion 236 is covered a portion of the transfer module 270, and functions as a stopper when external force is applied to the transfer module 270. With this configuration, deformation of the frame 230 can be prevented even when force is applied from front, back, left, right and twist directions, and rigidity of the printer housing can be improved. In other words, as the protrusion 236 of the frame 230 is inserted in the engaging hole 271 of the transfer module 270, the sidewall 231 can be prevented from being deformed inward or outward, and rigidity of the printer housing can be improved.

In the first embodiment, as described above, the sidewall 131 is supported by the back surface member 134 under a state that the one end portion 134*a* of the back surface member 134 contacts the inner surface of the sidewall 131 while the support portion 135 contacts the outer surface of the sidewall 131. Meanwhile, in this embodiment, the sidewall 231 is supported by the back surface member 234 via the transfer module 270 attached to the sidewall 231 by inserting the protrusion 236 of the back surface member 234 of the frame 230 in the engaging hole 271 of the transfer module 270. In other words, in this embodiment, the sidewall 231 and the back surface member 234 are connected via the upper surface member 233 while being connected via the transfer module 270, different from the upper surface member 233.

Specifically, an angle between the sidewall 231 and the back surface member 234 is a right angle, and the protrusion 236 is provided at the back surface member 234. Thus, even when a force is applied to the sidewall 231, the sidewall 231 supported by the back surface member 234 can be prevented from being bent. Further, as the protrusion 236 is inserted in the engaging hole 271, the position of the sidewall 231 with respect to the back surface member 234 does not move.

Figure 14A:
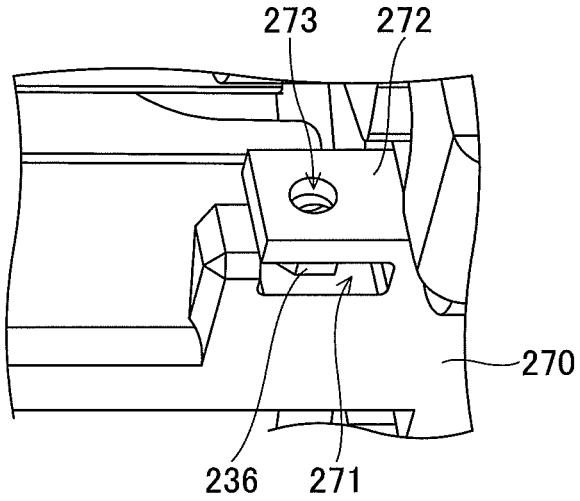
FIG. 14A and FIG. 14B are views illustrating another example of the printer of the second embodiment.
Figure 14B:
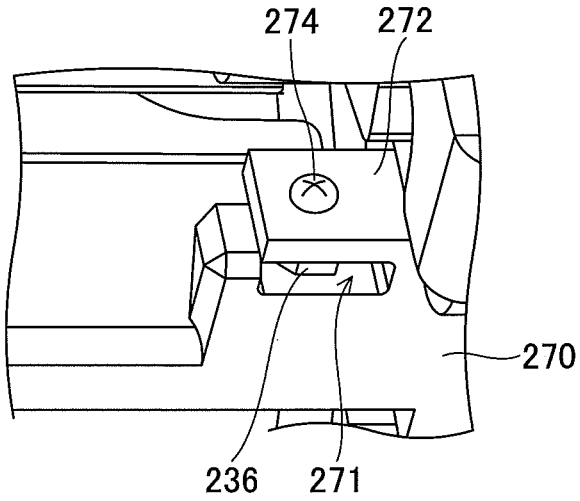

Further, as illustrated in FIG. 14A and FIG. 14B, in the printer of the embodiment, a through-hole 273 may be provided in a cover portion 272 of the engaging hole 271 of the transfer module 270. Then, the transfer module 270 may be fixed to the frame 230 by a screw 274 by inserting the screw 274 in the through-hole 273 under a state that the protrusion 236 is inserted in the engaging hole 271. FIG. 14A is a perspective view illustrating a state in which the protrusion 236 and the transfer module 270 are not fixed by a screw 274, and FIG. 14B is a perspective view illustrating a state in which the protrusion 236 and the transfer module 270 are fixed by the screw 274.

Figure 15A:
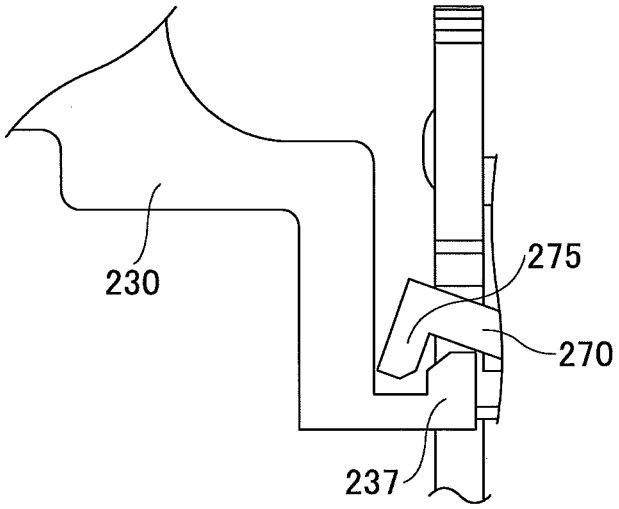
FIG. 15A and FIG. 15B are views illustrating yet another example of the printer of the second embodiment.
Figure 15B:
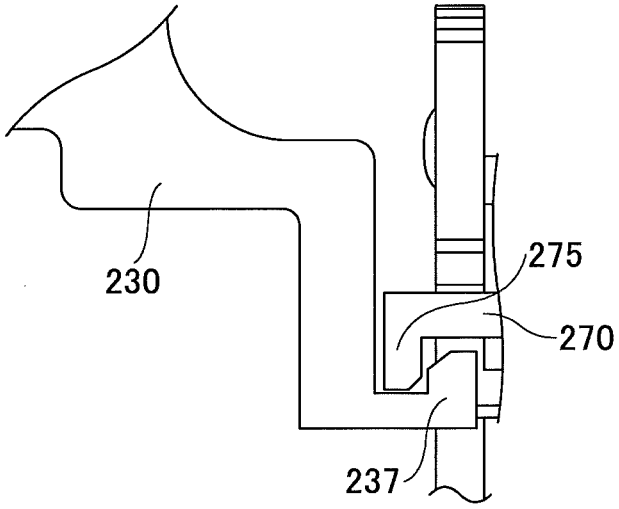

Further, as illustrated in FIG. 15A and FIG. 15B, a hook 237 may be provided at the frame 230 and a hook 275 corresponding to the hook 237 may be provided at the transfer module 270. Then, the transfer module 270 may be attached to the frame 230 by hanging the hook 275 of the transfer module 270 on the hook 237 of the frame 230. FIG. 15A illustrates a state in which the hook 275 is started to engage with the hook 237, and FIG. 15B illustrates a state in which the hook 275 is hung on the hook 237 and the transfer module 270 is attached to the frame 230. The hook 237 of the frame 230 may be provided at the back surface member 234 of the frame 230.

According to the printer of the embodiment, as the frame 230 is formed by the metal plate, the printer can be manufactured with low cost. Further, as the transfer module 270 whose strength of the housing is high is attached to the sidewall 231 of the frame 230, the strength of the printer housing including the frame 230 can be increased by the transfer module 270, and the frame 230 is not deformed even when fallen.

Other parts, not described above, are the same as those of the first embodiment.

Third Embodiment

Next, a printer of a third embodiment is described. The printer of the embodiment has a structure in which a cutter unit is further mounted on the printer of the second embodiment, and a cutter drive unit that drives the cutter unit is attached to the sidewall of the frame. With this, strength of the printer housing including the frame can be furthermore increased. Specifically, the cutter drive unit is attached to the sidewall 232 illustrated in FIG. 9A and FIG. 9B.

Figure 16:
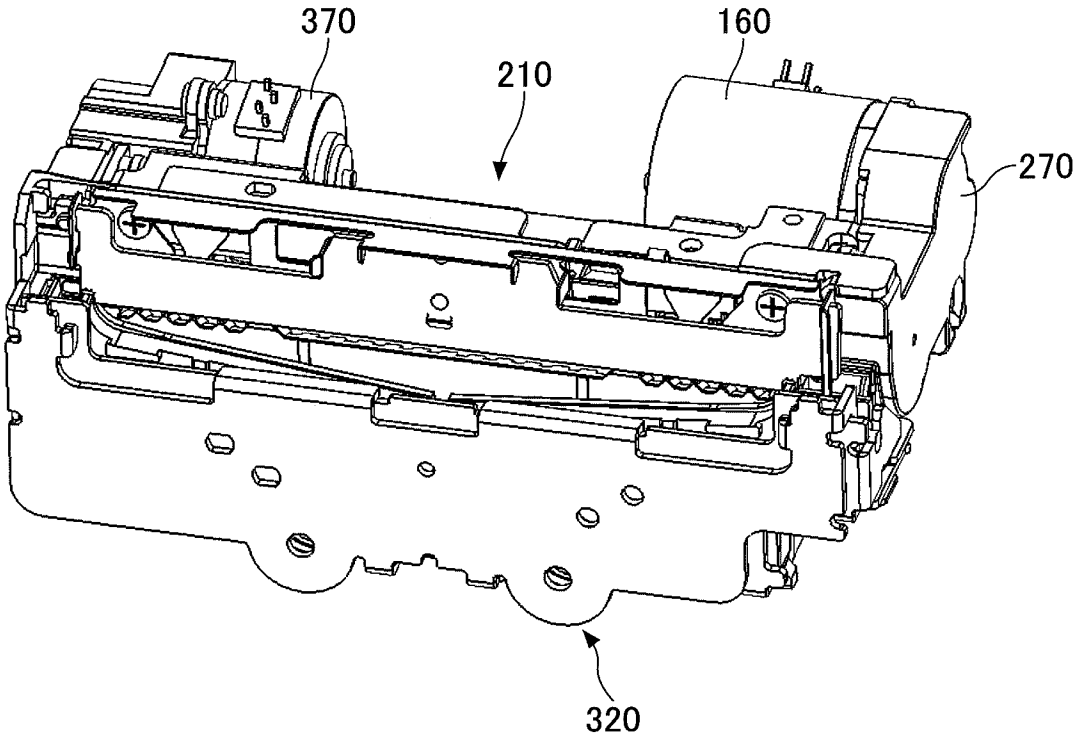
FIG. 16 is a perspective view of an example of a printer of a third embodiment.
Figure 17:
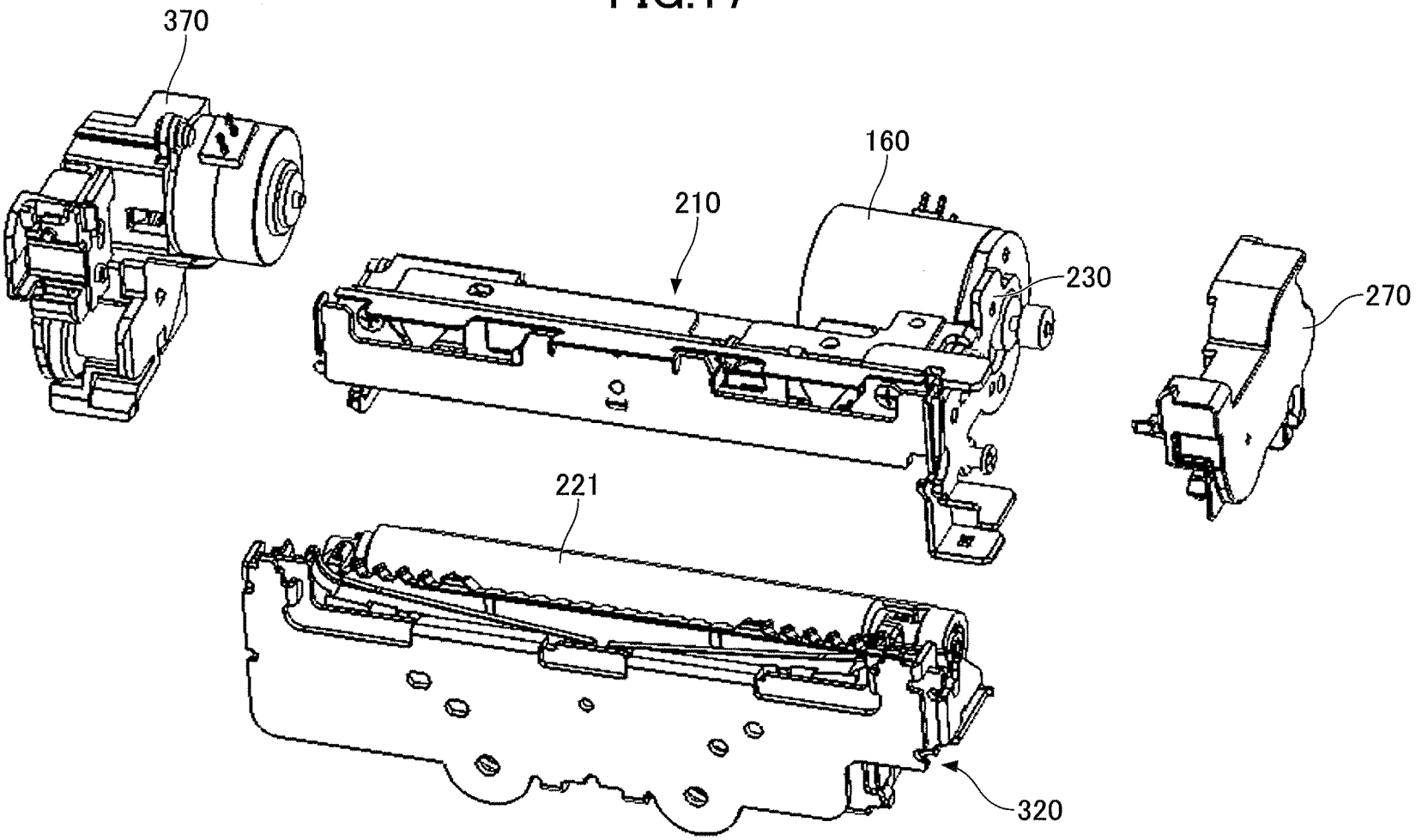
FIG. 17 is an exploded perspective view of an example of the printer of the third embodiment.

FIG. 16 is a perspective view of the printer of the embodiment, and FIG. 17 is an exploded perspective view of the printer of the embodiment. As illustrated in FIG. 16 and FIG. 17, the printer of the embodiment includes the printer mechanical unit 210 and a cutter unit 320 connected to the printer mechanical unit 210.

The cutter unit 320 includes the platen roller 221, and a fixed cutter and a movable cutter, not illustrated in the drawings, that cut a print paper.

Figure 18:
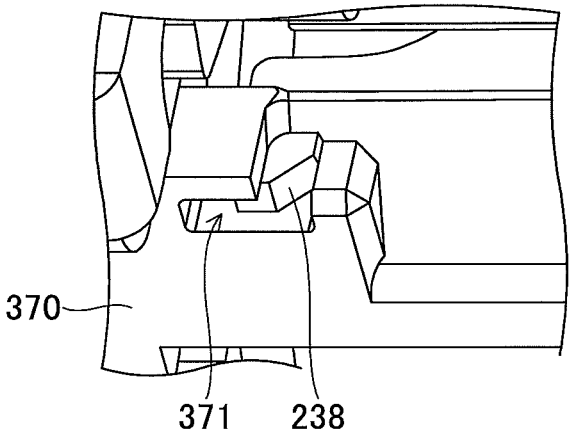
FIG. 18 is a view illustrating an example of the printer of the third embodiment.

A cutter drive unit 370 that drives the movable cutter of the cutter unit 320 is attached to the frame 230 of the printer mechanical unit 210. The cutter drive unit 370 includes a motor for driving the movable cutter, and a transfer module such as a gearbox. In this embodiment, as illustrated in FIG. 18, a protrusion 238 is provided at the back surface member 234 of the frame 230 near the sidewall 232, and the cutter drive unit 370 is provided with an engaging hole 371 corresponding to the protrusion 238.

In this embodiment, the cutter drive unit 370 can be attached to the frame 230 by inserting the protrusion 238 of the frame 230 in the engaging hole 371 of the cutter drive unit 370. With this, similar to the reason for the case when the transfer module 270 is attached to the frame 230, strength of the sidewall 232 of the frame 230 can be increased.

Other parts, not described above, are the same as those of the second embodiment. Furthermore, although it is described that the frame 230 and the cutter drive unit 370 are connected by the protrusion 238 and the corresponding engaging hole 371, the frame 230 and the cutter drive unit 370 may be connected by hooks, similarly as that described with reference to FIG. 15.

According to the embodiment, a printer including a frame to which a gearbox, a motor or the like is attached can be manufactured with low cost, and can have high strength for the frame or the like.

Although a preferred embodiment of the printer has been specifically illustrated and described, it is to be understood that minor modifications may be made therein without departing from the spirit and scope of the invention as defined by the claims.

The present invention is not limited to the specifically disclosed embodiments, and numerous variations and modifications may be made without departing from the spirit and scope of the present invention.

What is claimed is:

1. A printer comprising:
a print head;
a platen roller;
a frame, to which the print head or the platen roller is attached, that includes
a frame body provided to extend in a longitudinal direction of the platen roller,
a sidewall that is perpendicularly bent from the frame body with respect to the longitudinal direction of the platen roller, and
a back surface member that is bent from the frame body in parallel to the longitudinal direction of the platen roller, the back surface member including an end portion and a support portion,
wherein the end portion and the support portion are provided such that the sidewall is interposed between the end portion and the support portion, and such that the end portion and the support portion support the sidewall from an inner side and an outer side of the sidewall, respectively.

2. The printer according to claim 1, further comprising:
a transfer motor for rotating the platen roller; and
a transfer module for transmitting a rotation of the transfer motor to the platen roller,
wherein the transfer motor and the transfer module are attached to the sidewall of the frame.

3. The printer according to claim 1, wherein the frame is formed by bending a single plate.

4. A printer comprising:
a print head;
a platen roller;
a transfer motor for rotating the platen roller;
a transfer module that transmits a rotation of the transfer motor to the platen roller; and
a frame formed by bending a single plate, to which the print head is attached, the frame including
a frame body provided to extend in a longitudinal direction of the platen roller, and
a sidewall that is perpendicularly bent from the frame body with respect to the longitudinal direction of the platen roller,
the transfer module being attached to the sidewall,
the frame including a first engaging portion, and
the transfer module including a second engaging portion that engages the first engaging portion of the frame.

5. The printer according to claim 4, wherein the first engaging portion is a protrusion and the second engaging portion is an engaging hole.

6. The printer according to claim 4, wherein the first engaging portion is a first hook and the second engaging portion is a second hook.

7. The printer according to claim 4, further comprising:
a cutter unit configured to cut a print paper; and
a cutter drive unit that drives a movable cutter of the cutter unit,
wherein the frame further includes a second sidewall that is perpendicularly bent from the frame body with respect to the longitudinal direction of the platen roller,
wherein the frame further includes a third engaging portion, and
wherein the cutter drive unit includes a fourth engaging portion that engages the third engaging portion of the frame.

8. The printer according to claim 7, wherein the third engaging portion is a protrusion and the fourth engaging portion is an engaging hole.

* * * * *